United States Patent [19]

Brose

[11] 4,109,585

[45] Aug. 29, 1978

[54] FRICTIONALLY SNUBBED RAILWAY CAR TRUCK

[75] Inventor: Albert F. Brose, St. Louis, Mo.

[73] Assignee: AMSTED Industries Incorporated, Chicago, Ill.

[21] Appl. No.: 753,789

[22] Filed: Dec. 23, 1976

[51] Int. Cl.[2] ..... B61F 5/06; B61F 5/12; B61F 5/24; B61F 5/50

[52] U.S. Cl. ..... 105/197 DB; 267/9 A

[58] Field of Search ..... 105/197 D, 197 DB; 267/3, 4, 9 A, 9 C

[56] References Cited

U.S. PATENT DOCUMENTS

| | | | |
|---|---|---|---|
| 2,053,990 | 9/1936 | Goodwin | 105/197 DB |
| 2,837,034 | 6/1958 | Shafer | 105/197 D |
| 2,953,995 | 9/1960 | Baker | 105/197 DB |

*Primary Examiner*—Drayton E. Hoffman
*Assistant Examiner*—Howard Beltran
*Attorney, Agent, or Firm*—Fred P. Kostka

[57] ABSTRACT

A winged friction shoe is provided to frictionally engage both the side frame column and bolster in order to control the oscillating movement of the latter. The wings of the friction shoe are formed with a surface which is inclined with respect to the surface which they engage to provide a couple force which urges the shoe into lateral alignment with a friction surface when the friction surface and shoe are initially in a laterally non-parallel relationship.

8 Claims, 4 Drawing Figures

FIG. 1
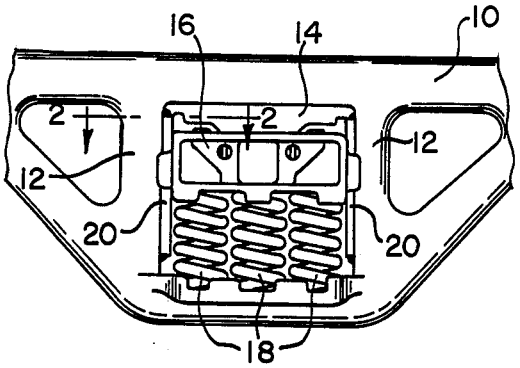
FIG. 2
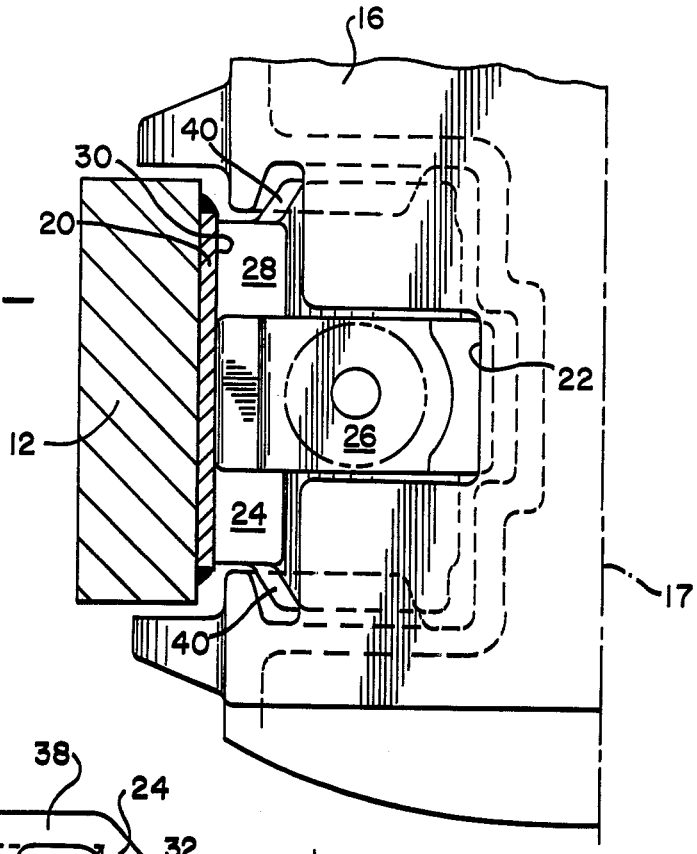
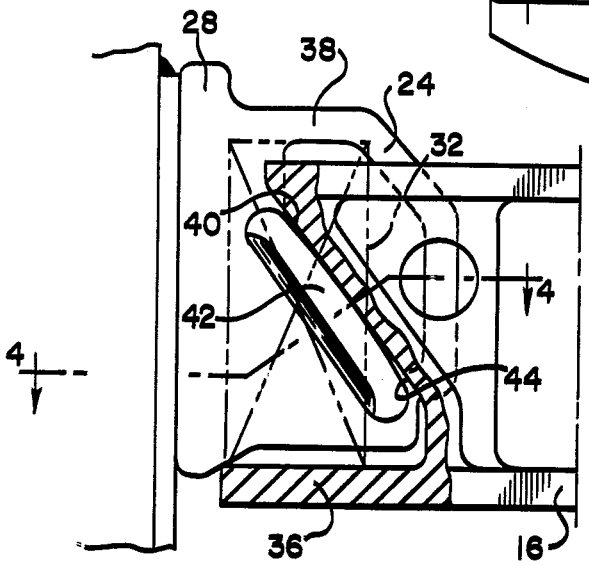
FIG. 3

FRICTIONALLY SNUBBED RAILWAY CAR TRUCK

BACKGROUND AND SUMMARY OF THE INVENTION

The present invention relates to a friction device for a railway car truck and more particularly to a novel device which serves to force a winged friction shoe to rock about a vertical axis to align the friction surface on the shoe with the friction surface of a friction plate should these surfaces be initially in a laterally non-parallel relationship.

The present apparatus is an improvement of the apparatus described in U.S. Pat. No. 2,953,995 issued Sept. 27, 1960 which is incorporated herein by reference thereto.

The type of railway car truck to which the present invention relates comprises, generally, spaced side frame members each having an opening arranged to resiliently support opposite ends of a bolster. A spring biased friction shoe has a wall engageable with a friction surface on the side frame. The friction shoe also includes flanges or wings which project laterally from a body portion and bear against guiding surfaces on the bolster. The shoe frictionally engages both the side frame and bolster for controlling the oscillating movement of the latter. Heretofore, the wings and guiding surfaces were constructed and arranged so that the friction wall of the shoe was constrained for movement in a plane parallel to the longitudinal axis of the bolster.

In some instances and under certain operating conditions the side frame column friction plate is not aligned in a parallel relationship to the longitudinal axis of the bolster. When this occurs the friction wall of the shoe will not bear squarely against the side frame column friction plate thereby greatly decreasing the bearing area. This causes the friction shoe and side frame column friction plate to wear unevenly thereby shortening the service life of both.

It is a primary object of the present invention to provide a railway car truck with a friction shoe constructed and arranged to overcome the difficulties encountered heretofore and thereby improve the service life and reliability thereof.

According to the present invention this is accomplished by providing friction shoe wings with surfaces that are inclined with respect to the guiding surfaces that they engage so that the wings initially contact the guiding surfaces at a point adjacent the friction shoe spring pocket. When the friction surface on the side frame is not laterally parallel to the friction wall of the shoe, a rotational couple force is created that causes the friction shoe to rock about a vertical axis until the friction wall of the shoe bears squarely against the friction surface on the side frame.

BRIEF DESCRIPTION OF THE DRAWINGS

FIG. 1 is a fragmentary side elevational view of a railway car truck embodying the present invention.

FIG. 2 is a view, partly in section, taken along line 2—2 of FIG. 1.

FIG. 3 is a detailed side elevational view of the side frame column, friction shoe and bolster with part of the bolster broken away.

DESCRIPTION OF THE PREFERRED EMBODIMENT

Figure 4:
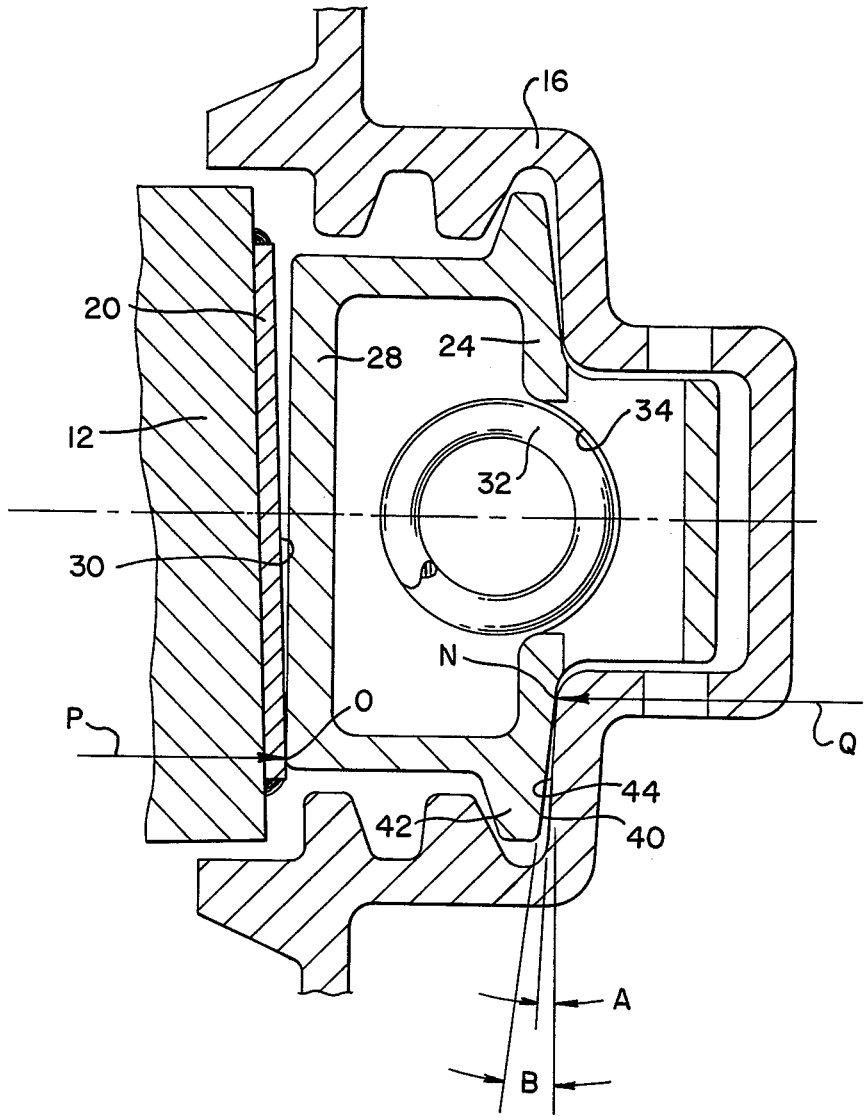
FIG. 4 is a fragmentary sectional view taken along line 4—4 of FIG. 3 and illustrating the side frame column, bolster and the preferred embodiment of the friction shoe of the present invention.

Referring now to the drawings, in FIG. 1 there is shown a side frame 10 having a pair of columns 12 defining the sides of a bolster opening 14 formed in the frame. One end of a bolster 16 is resiliently supported in the bolster opening 14 on springs 18. Friction plates 20 may be integral with or suitably mounted on side frame columns 12.

As shown in FIG. 2, bolster 16 is formed with pockets 22 on opposite sides of a longitudinal axis 17. The pockets each receive a friction shoe 24 adjacent to a respective side frame column 12.

Friction shoe 24 comprises a body portion 26 having a friction wall 28 which frictionally engages a friction surface 30 on the side frame column friction plate 20.

Friction shoe 24 is urged into frictional engagement with plate 20 by a spring 32 shown diagrammatically in FIG. 3. Spring 32 is received in a central spring pocket 34 (FIG. 4) formed in friction shoe 24 and is compressed between a lower wall 36 of bolster 16 and an upper wall 38 of friction shoe 24. Spring 32 urges an upper surface 40 of sloped wings 42, which project outwardly from opposite sides of body portion 26 of friction shoe 24, into engagement with a guiding surface 44 of bolster 16.

The upper surface 40 of sloped wings 42 is vertically convex as shown in FIG. 3. The convex upper surface 40 permits the friction shoe 24 to rock slightly on guiding surface 44 about an axis substantially parallel to longitudinal axis 17 of bolster 16. This freedom to rock permits the friction shoe 24 to vertically align its friction wall 28 with the friction surface 30 of plate 20 under conditions in which the friction surface 30 and friction wall 28 are not initially vertically parallel.

Heretofore, winged friction shoes have been so constructed as to incapable of compensating for side frame column friction plates which are not laterally parallel to the friction wall of a friction shoe. This non-parallel condition is illustrated in FIG. 4. The side frame column 12 and friction plate 20 are shown at a slight angle with respect to friction wall 28 of shoe 24. This causes friction wall 28 to contact friction surface 30 along a line which in this sectional view appears as a point O.

Guiding surface 44 of bolster 16 is inclined by an angle A with respect to the longitudinal axis 17 of bolster 16. This angle is formed as a result of the manufacturing draft of the bolster casting and is typically on the order of about 1.5°.

According to the present invention, the upper surfaces 40 of wings 42 are each inclined toward friction wall 28 of friction shoe 24 by an angle B as shown in FIG. 4. Angle B is greater than angle A and preferably in the range of about 2° to about 5°. Since angle B is greater than angle A, upper surface 40 forms an angle with guiding surface 44 preferably in the range of about 0.5° to about 3.5°.

The angle between upper surface 40 and guiding surface 44, having its apex toward the center of friction shoe 24, causes upper surface 40 to contact guiding surface 44 at a point N adjacent spring pocket 34 near the center of shoe 24.

Point O indicates the point of contact between side frame column friction plate 20 and friction wall 28 of friction shoe 24, and point N indicates the point of contact between guiding surface 44 of bolster 16 and upper surface 40 of friction shoe wing 42. Forces P and Q, exerted by the side frame 10 and bolster 16 on the friction shoe 24, act through the points of contact O and N respectively.

Therefore, as illustrated in FIG. 4, whenever side frame column friction plate 20 is not initially laterally parallel to friction wall 28 of friction shoe 24, a rotational couple of the forces P and Q will be exerted on friction shoe 24 forcing it to rock about a vertical axis and urge the friction wall 28 into alignment squarely against friction surface 30 of side frame column friction plate 20.

It should be noted further that the friction shoe receiving pocket need not be provided in the bolster as described herein, but may, for example, be formed in the side frame. In this latter type of construction, the friction shoe would engage a relatively movable friction surface on the bolster and would be in spring biased engagement with guiding surfaces in the side frame member.

I claim:

1. A friction apparatus for a railway car truck comprising: a side frame having a substantially upright column partially defining a bolster opening; a bolster resiliently supported in said opening for vertical movement therein; a vertical planar friction surface on said column; guiding surfaces on said bolster; a friction shoe comprising a substantially planar wall, a vertical spring pocket and wings projecting laterally outward from said spring pocket and having guided surfaces; a spring in said spring pocket urging said wings into engagement with said guiding surfaces thereby guiding said wall into engagement with said friction surface; said wing guided surfaces being inclined toward said wall and said guiding surfaces to form an angle with said guiding surfaces having its apex adjacent said spring pocket to tend to rotate said friction shoe about the spring.

2. The apparatus as defined in claim 1 further characterized in that the angle is at least about 0.5°.

3. The apparatus as defined in claim 1 further characterized in that the angle is in the range of about 0.5° to about 3.5°.

4. The apparatus as defined in claim 1 further characterized in that the surface of said wing is vertically convex.

5. A railway truck comprising a side frame having a substantially upright column defining a side of an opening, a bolster supported in said opening for vertical movement relative thereto, a column friction surface provided on said substantially upright column, guide means including a guiding surface on said bolster, a friction shoe disposed between said bolster and said column, said friction shoe including a friction wall engageable in face-to-face relationship with said column friction surface, wing means on said friction shoes disposed in said guide means, said wing means having a surface inclined relative to said guiding surface to create a generally horizontal coupling force tending to rotate said friction shoe about a vertical axis and thereby urge said friction wall toward face-to-face engagement with said column friction surface under conditions when said friction surface and friction wall are out of parallel alignment.

6. The invention as defined in claim 5 wherein said inclined wing surface is inclined to form an angle with said guiding surface which intersects along a line disposed inwardly of the line of engagement of said friction surface and said friction shoe wall.

7. The invention as defined in claim 5 wherein said angle is at least about 0.5°.

8. The invention as defined in claim 5 wherein said angle is in the range of between about 0.5° and 3.5°.

* * * * *